US008662796B2

(12) United States Patent
Brown

(10) Patent No.: US 8,662,796 B2
(45) Date of Patent: Mar. 4, 2014

(54) METHOD AND APPARATUS FOR LINING TUNNEL WALLS OR TUNNEL CEILINGS WITH PROTECTIVE NETS

(75) Inventor: Shane Brown, Welshpool (AU)

(73) Assignees: Geobrugg AG, Romanshorn (CH); Rock Engineering (Aust) Pty Ltd., Welshpool, WA (AU)

( * ) Notice: Subject to any disclaimer, the term of this patent is extended or adjusted under 35 U.S.C. 154(b) by 41 days.

(21) Appl. No.: 13/057,816

(22) PCT Filed: Jul. 24, 2009

(86) PCT No.: PCT/EP2009/005392

§ 371 (c)(1), (2), (4) Date: Mar. 9, 2011

(87) PCT Pub. No.: WO2010/015339

PCT Pub. Date: Feb. 11, 2010

(65) Prior Publication Data

US 2011/0150575 A1 Jun. 23, 2011

(30) Foreign Application Priority Data

Aug. 8, 2008 (AU) ..... 2008904072

(51) Int. Cl.
*E21D 19/00* (2006.01)

(52) U.S. Cl.
USPC ..... 405/302.3; 405/272; 405/288; 299/11

(58) Field of Classification Search
USPC ..... 405/258.1, 272, 288, 294, 296, 302.3; 299/11, 95; 269/3, 6, 95, 32, 24, 27; 294/198, 202, 115; 403/328, 330
See application file for complete search history.

(56) References Cited

U.S. PATENT DOCUMENTS

| | | | | |
|---|---|---|---|---|
| 3,399,927 | A * | 9/1968 | Groetschel | 299/11 |
| 3,902,614 | A * | 9/1975 | Roberts et al. | 414/735 |
| 4,358,159 | A | 11/1982 | Groetschel | |
| 5,816,750 | A | 10/1998 | Steffenino | |
| 2007/0176158 | A1 * | 8/2007 | Robinson | 256/12.5 |
| 2008/0279627 | A1 | 11/2008 | Junker et al. | |

FOREIGN PATENT DOCUMENTS

| | | | |
|---|---|---|---|
| DE | 1924749 | * | 11/1970 |
| DE | 2836659 | A1 | 3/1980 |
| DE | 2945082 | C2 | 10/1981 |
| DE | 102004014873 | A1 | 10/2005 |
| GB | 2046823 | A | 11/1980 |
| RU | 1055884 | A | 11/1983 |

* cited by examiner

*Primary Examiner* — Sean Andrish
(74) *Attorney, Agent, or Firm* — Brian Roffe

(57) ABSTRACT

In a method for lining tunnel walls or ceilings with protective nets or the like, web-shaped protective net material is unwound from a reel and is fastened to the tunnel walls or ceiling by tie bolts. The reel is rotatably arranged. The rotation of the reel about a shaft is controlled in order to unwind the protective net material, the shaft being mechanically moved in steps along the tunnel walls or ceiling together with the reel. The protective net material unwound in each step is preferably stretched and mechanically fastened. The individuals carrying out these processes are thus not exposed to any direct risk, while the lining process can be accelerated.

18 Claims, 3 Drawing Sheets

METHOD AND APPARATUS FOR LINING TUNNEL WALLS OR TUNNEL CEILINGS WITH PROTECTIVE NETS

FIELD OF THE INVENTION

The invention relates to a method for lining tunnel walls or tunnel ceilings with protective nets wherein web-shaped protective net material is unwound from a reel, and to an apparatus for implementing the method.

BACKGROUND OF THE INVENTION

It is known to line tunnels, for example mining tunnels, with protective nets which are preferably made of steel wire. The web-shaped protective net material is unwound from a reel and fastened to the tunnel walls or the tunnel ceiling by means of tie bolts. In general, lifting platforms or similar are used in order to lay out the protective net material. The heavy reel is difficult to handle, and the workers are exposed to a number of risks.

OBJECTS AND SUMMARY OF THE INVENTION

The object forming the basis of the present invention is to propose a method of the type specified at the start and to provide an apparatus for implementing the method by means of which the operation is substantially simplified and speeded up, and the safety of the individuals carrying out the work is increased.

This object is achieved according to the invention by a method wherein a reel is arranged rotatably, and in order to unwind the protective net material, the rotational movement of the reel is controlled the reel is moved mechanically along the tunnel walls or tunnel ceiling, and by an apparatus having a holder for securing a shaft in relation to which the reel with the web-shaped protective net material is disposed rotatably, means for controlling rotational movement of the reel about the shaft and means for moving, step by step, the holder accommodating the shaft with the reel along the tunnel walls or tunnel ceiling.

Preferred further developments of the method according to the invention and of the apparatus according to the invention form the subject matter of the dependent claims.

The method according to the invention for lining tunnel walls or tunnel ceilings with protective nets and the apparatus according to the invention for implementing the method enable simple and nevertheless precise handling of the heavy reels of protective net material and mechanical implementation of the unwinding and fastening process which can be controlled, for example, from a main unit, for example a conventional drill jumbo, so that the individuals carrying out these processes are not exposed to any direct risk, and safety is substantially improved.

BRIEF DESCRIPTION OF THE DRAWINGS

In the following, the invention will be described in greater detail by means of the drawings. These show as follows.

DETAILED DESCRIPTION OF THE INVENTION

Figure 1:
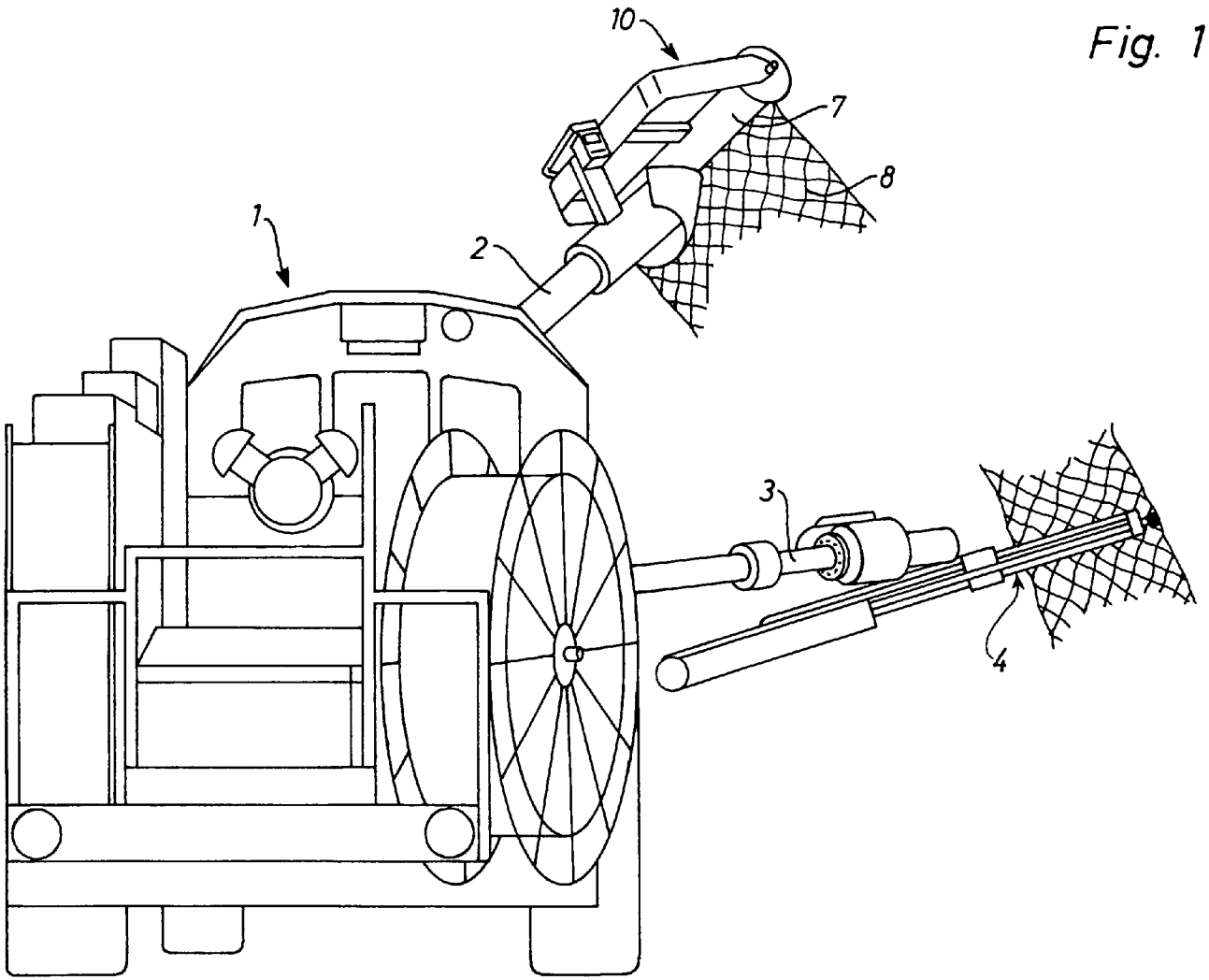
FIG. 1 is a perspective illustration of a main unit for lining tunnel walls and tunnel ceilings with protective nets, equipped with an apparatus for unwinding the protective net material from a reel and with an anchoring device.

FIG. 1 shows a main unit 1 according to the invention for lining tunnel walls or tunnels ceilings with protective nets. Attached to the main unit 1 by one end is a moveable, telescopic arm 2 which on the other end has an apparatus 10 for unwinding the web-shaped protective net material 8 from a reel 7. The apparatus 10, which will be described in greater detail below by means of FIGS. 2 to 5, can be moved by means of the arm 2 in steps along the tunnel walls or tunnel ceiling, the reel 7 being held substantially parallel to the tunnel walls or tunnel ceiling and transversely to the direction of movement of the arm 2. The protective net material 8 unwound in the respective step is fastened to the tunnel wall or to the tunnel ceiling by means of an anchoring device 4 which is borne by a further moveable, telescopic arm 3 of the main unit 1.

In this way, for example, a first side wall of the tunnel can first of all be covered with the web-shaped protective net material 8 to half way up, and corresponding tie bolts are driven in by means of the anchoring device 4, after which the apparatus 10 is raised by the arm 2 and a further section of the unwound protective net material 8 is stretched and then fastened. The process is continued until the tunnel ceiling and the other side wall are also covered with the protective net material 8.

The main unit 1 is then moved within the tunnel in the longitudinal direction of the tunnel depending upon the web width of the protective net material 8 in order to cover a further tunnel section. The main unit 1 is advantageously equipped with an appropriate chassis.

In the following, the apparatus 10 for unwinding the web-shaped protective net material 8 from the reel 7 will now be described. The web-shaped protective net material 8 is wound on a tube 6 into the reel 7. The tube 6 with the reel 7 is held in a holder 11 rotatably about an axis of rotation A. According to FIG. 2 the holder 11 comprises a base 14 (with an upper side 12 and a lower side 13 and if need be with lateral side regions 15 directed upwards at an angle), and two carrying arms 20 sticking out from the latter, the free ends of which are provided with means for securing end parts 31 of a shaft 30 forming the axis of rotation A and projecting through the tube 6. With the exemplary embodiment shown in FIGS. 3 and 5 these means are formed by a respective pair of clamping jaws 22 moveable from an open position into a closed position. Assigned to the shaft 30 are lateral guide plates 33 which interact with the clamping devices and assist with holding the shaft 30 securely in the clamping jaws 22.

The clamping jaws 22 are respectively hinged pivotably by a first end 52 on a hollow element 21 of the respective carrying arm 20 (pivot axis 51) and can be moved rotatably by a common linear drive disposed within the hollow element 21. Preferably there is provided in the hollow element 21 a housing 64 with a hydraulic piston/cylinder unit 63 by means of which a toothed rack 61 is operated which by means of a respective toothed wheel 60 causes the clamping jaws 22 to swivel out of the open position into the closed position and vice versa.

Figure 4:
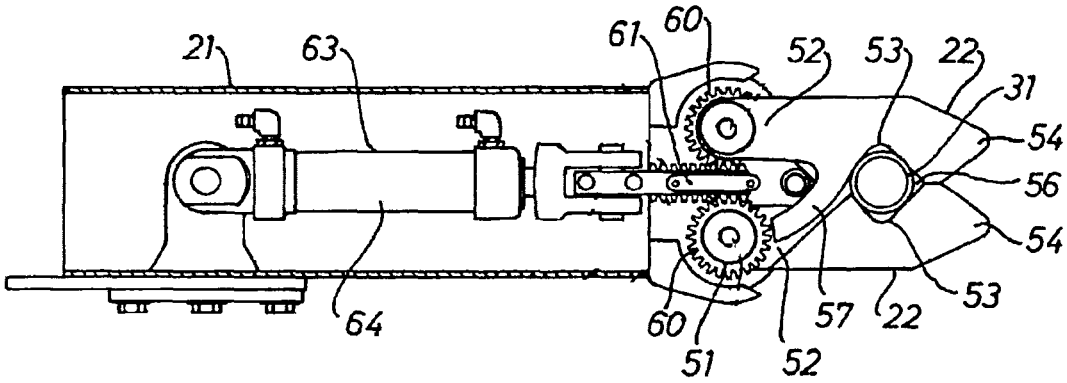
FIG. 4 is a clamping device as part of the apparatus according to FIG. 2 in a closed position.

On second ends 54 of the clamping jaws 22 a respective recess 53 is provided, between which recesses 53 the end parts 31 of the shaft 30 are clamped in the closed position of the clamping jaws 22. The recesses 53 together form a space 56 with a diamond-shaped or rectangular cross-section (FIG. 4).

Figure 5:
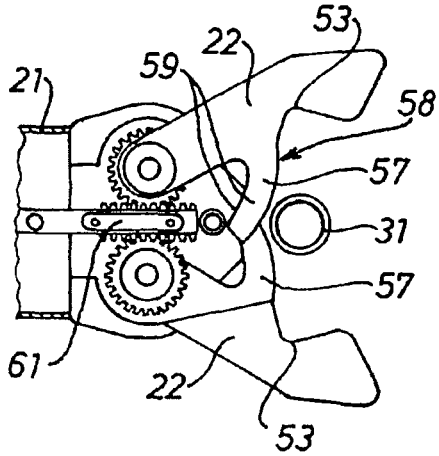
FIG. 5 is part of the clamping device according to FIG. 4 in an open position.

Moreover, each clamping jaw 22 has between the first end 52 and the recess 53 an extension or a projection 57. The projections 57 extend reciprocally such that in the open position of the clamping jaws 22 according to FIG. 5 bearing surfaces 58 are formed for the end parts 31 of the shaft 30 to be clamped. Upon closing the clamping jaws 22 the end parts 31 of the projections 57 are guided into the recesses 53 or into the space 56. The projections 57 are positioned to the side such that their distal ends 59 overlap in the open position of the clamping jaws 22 (FIG. 5). In the closed position the spaces 56 of the two pairs of clamping jaws correspond so that the shaft 30 is held parallel to the base 14 of the holder 11. As mentioned above, when moving the clamping jaws 22 from the open position into the closed position self-centering or self-positioning of the shaft 30 takes place.

The apparatus 10 according to the invention for unwinding the web-shaped protective net material 8 is furthermore provided with means 40 for controlling the rotational movement of the reel 7 about the axis of rotation A or about the shaft 30 held securely in place.

Figure 2:
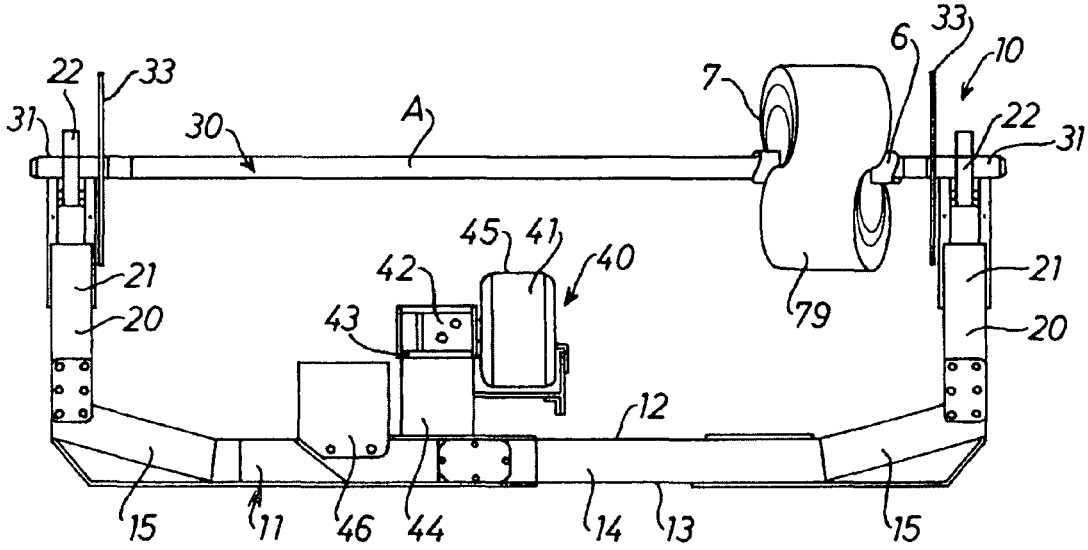
FIG. 2 is a front view of the apparatus for unwinding the protective net material.
Figure 3:
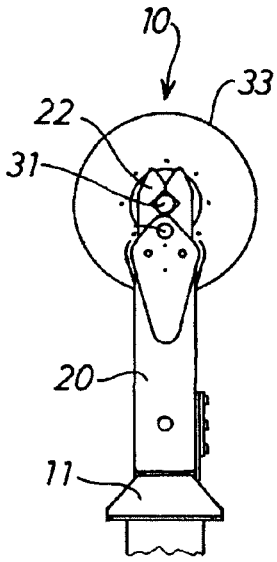
FIG. 3 is a side view of the apparatus according to FIG. 2.

With the exemplary embodiment shown in FIG. 2 these means 40 comprise a pressure roller 41 engaging with the reel surface 79 and which is operatively connected to a (preferably hydraulic) drive motor 42. The axis of rotation of the pressure roller 41, which could also be e.g. a tyre or a toothed wheel, is disposed parallel to the shaft 30. The drive motor 42 with the pressure roller 41 is positioned on a platform 43 which is disposed moveably on the base 14 of the holder 11 in order to hold the shaft 30 secure. In order to move the platform 43, and so in order to move the pressure roller 41 radially to the reel 7, at least one preferably hydraulic piston/cylinder unit is provided which is accommodated in a housing 44. A further housing 46 contains various working and safety components for these piston/cylinder units and the hydraulic drive motor 42.

The pressure roller 41 can be brought into contact with the reel surface 79 by moving the platform 43 with its outer peripheral area 45, and advantageously in the central region of the reel 7. The pressure roller 41 is driven rotatably in order to bring about controlled unwinding of the protective net material 8, or the rotation of the pressure roller 41 is stopped in order to prevent unwinding. Upon unwinding, the reel diameter is reduced and the pressure roller is automatically moved by the piston/cylinder units so as to always remain in contact with the reel surface 79. The pressure roller 41 and the whole means 40 for controlling the rotational movement of the reel 7 can therefore—as required—be used both for the controlled unwinding of the protective net material 8 and as a brake acting on the reel 7.

Instead of the piston/cylinder units, other means, such as for example spring elements, could also be used for automatically moving the pressure roller.

Instead of clamping jaws 22 other means could also be used to secure the shaft 30. Instead of a shaft 30 the reel itself could also be formed preferably with coaxial lateral shafts on both sides.

The method according to the invention for lining tunnel walls or tunnel ceilings with protective nets and the apparatus according to the invention for implementing the method enable simple and nevertheless precise handling of the heavy protective net material reels as well as mechanical implementation of the unwinding and fastening process which can be controlled, for example, by a main unit, so that the individuals carrying out these processes are not exposed to any direct risk, and safety is substantially improved.

The invention claimed is:

1. A method for lining tunnel walls or tunnel ceilings with protective nets, comprising:

arranging a reel of web-shaped protective net material on a shaft to enable the reel to rotate about the shaft, securing ends of the shaft, using a securing system, rotating the reel using a rotation system that engages with a surface of the reel to cause rotation of the reel, while the ends of the shaft are secured by the securing system, and thus unwinding of the protective net material from the reel, the rotation system comprising a pressure roller engaging with the surface of the reel, and controlling rotational movement of the reel by maintaining engagement of the rotation system with the surface of the reel during unwinding of the reel and selectively actuating the rotation system, while engaged with the surface of the reel, to provide for unwinding of the protective net material from the reel and for braking of the reel, the reel being movable along the tunnel walls or tunnel ceiling, wherein the step of controlling rotational movement of the reel comprises:

controlling rotational movement of the pressure roller; and moving the pressure roller in a radial direction of the reel as the protective net material unwinds from the reel to maintain contact between the pressure roller and the surface of the reel.

2. The method according to claim 1, further comprising stretching and fastening portions of the protective net material after unwinding from the reel to the tunnel walls or tunnel ceiling.

3. The method according to claim 1, further comprising:

attaching a movable, telescopic arm at one end to a main unit and at an opposite end to the shaft; and holding the shaft substantially parallel to the tunnel walls or tunnel ceiling and transversely to a direction of movement of the movable arm.

4. The method according to claim 3, further comprising:

fastening portions of the protective net material after unwinding the protective net material from the reel using an anchoring device arranged on an additional movable, telescopic arm attached to the main unit.

5. The method according to claim 3, further comprising:

moving the main unit incrementally within the tunnel in a longitudinal direction of the tunnel as a function of a width of the protective net material.

6. The method according to claim 1, wherein the securing system comprises a holder and two clamping devices, each of the clamping devices being arranged at a respective end of the holder, each of said clamping devices being configured to clamp a respective end portion of the shaft.

7. The method according to claim 1, further comprising:

mounting the securing system and the rotation system on a common base; and connecting the base to a movable, telescopic arm.

8. The method according to claim 1, wherein the reel includes a tube around which the protective net material is wound, further comprising mounting the reel onto the shaft such that the ends of the shaft project through the tube, whereby the reel and thus the tube rotate about a rotation axis defined by the shaft.

9. An apparatus for lining tunnel walls or tunnel ceilings with protective nets, comprising:

a shaft that rotatably supports a reel of protective net material such that the reel is rotatable about said shaft;

a holder that secures said shaft, and a rotation system that controls rotational movement of the reel about said shaft while said shaft is secured by said holder, said holder being movable along the tunnel walls or tunnel ceiling, said rotation system being maintained in engagement with a surface of the reel during unwinding of the reel and selectively actuated, while engaged with the surface of the reel, to provide for unwinding of the protective net material from the reel and for braking of the reel, said rotation system comprising a rotatable pressure roller adapted to engage with the surface of the reel and a drive motor operatively connected to said pressure roller for moving said pressure roller in a radial direction of the reel, said rotation system being configured to control rotational movement of the reel by controlling rotational movement of the pressure roller and moving, using the drive motor, the pressure roller in the radial direction of the reel as the protective net material unwinds from the reel while maintaining contact between the pressure roller and the surface of the reel.

10. The apparatus according to claim 9, wherein said holder comprises a base and two carrying arms extending from said base, each of said carrying arms having a free end that accommodates and secures a respective end part of said shaft.

11. The apparatus according to claim 10, wherein each of said carrying arms comprises a securing mechanism at the free end that accommodates and secures the respective end part of said shaft, each of said securing mechanisms comprising a pair of clamping jaws having an open position and a closed position, said clamping jaws being movable between the open and closed positions.

12. The apparatus according to claim 11, wherein in each of said securing mechanisms, said clamping jaws are pivotally hinged at a first end on a hollow element of the respective one of said carrying arms, each of said securing mechanisms further comprising a common linear drive arranged in said hollow element and configured to pivot said clamping jaws, said clamping jaws including a recess at a second end that selectively receives a respective one of said end parts of said shaft when said clamping jaws are in the closed position.

13. The apparatus according to claim 12, wherein each of said clamping jaws includes a projection between the first and second ends, each said projection overlapping to a side of the respective pair of said clamping jaws to thereby provide, when said clamping jaws are in the open position, bearing surfaces for said end parts of said shaft.

14. The apparatus according to claim 9, wherein said holder comprises a base, further comprising a platform that supports said drive motor and said pressure roller, said platform being movable relative to said base, further comprising a housing interposed between said base and said platform and that is adapted to receive a platform movement system that moves said platform relative to said base to thereby cause movement of said pressure roller.

15. The apparatus according to claim 9, further comprising:

a movement system that moves said holder along the tunnel walls or tunnel ceiling, said movement system comprising a main unit, and a movable, telescopic arm attached at one end to said main unit, said shaft being supported by an opposite end of said movable arm.

16. The apparatus according to claim 15, wherein said shaft extends substantially transversely to a direction of movement of said movable arm.

17. The apparatus according to claim 15, wherein said main unit further comprises an additional movable, telescopic arm and an anchoring device arranged on said additional movable arm, said anchoring device being configured to attach tie bolts or fasten the unwound protective net material to the tunnel walls or tunnel ceiling.

18. The apparatus according to claim 15, wherein said anchoring device is configured to stretch the unwound protective net material before fastening to the tunnel walls or tunnel ceiling.

* * * * *